US012649096B2

(12) United States Patent
Harris, Jr.

(10) Patent No.: US 12,649,096 B2
(45) Date of Patent: Jun. 9, 2026

(54) BASKETBALL SHOOTING TRAINING DEVICE AND METHOD OF USE

(71) Applicant: Joseph Harris, Jr., Austin, TX (US)

(72) Inventor: Joseph Harris, Jr., Austin, TX (US)

( * ) Notice: Subject to any disclaimer, the term of this patent is extended or adjusted under 35 U.S.C. 154(b) by 525 days.

(21) Appl. No.: 18/138,796

(22) Filed: Apr. 25, 2023

(65) Prior Publication Data

US 2024/0359076 A1 Oct. 31, 2024

(51) Int. Cl.

| | |
|---|---|
| ***A63B 69/36*** | (2006.01) |
| ***A63B 69/00*** | (2006.01) |
| ***A63B 71/06*** | (2006.01) |

(52) U.S. Cl.

CPC ..... *A63B 69/0071* (2013.01); *A63B 71/06* (2013.01); *A63B 2071/0694* (2013.01); *A63B 2208/0204* (2013.01); *A63B 2214/00* (2020.08)

(58) Field of Classification Search

CPC ..... A63B 69/0071; A63B 71/06; A63B 2071/0694; A63B 2208/0204; A63B 2214/00

USPC ..... 473/218, 257, 266, 270, 278, 279, 409, 473/417, 447

See application file for complete search history.

(56) References Cited

U.S. PATENT DOCUMENTS

| | | | | | |
|---|---|---|---|---|---|
| 4,248,431 | A * | 2/1981 | Burnes | A63B 69/3667 | 473/270 |
| 4,915,387 | A * | 4/1990 | Baxstrom | A63B 69/36 | 473/270 |
| 5,306,011 | A * | 4/1994 | Perry | A63B 69/3667 | 473/218 |
| 5,536,004 | A * | 7/1996 | Wiseman | A63B 69/0002 | 473/417 |
| 6,386,996 | B1 * | 5/2002 | Foster | A63B 69/0002 | 473/422 |
| 7,909,704 | B2 * | 3/2011 | Giusti | A63B 69/3673 | 473/270 |
| 9,421,444 | B1 | 8/2016 | Graham | | |
| D909,501 | S | 2/2021 | Knable | | |
| 11,033,793 | B2 | 6/2021 | Smith | | |
| 2002/0098947 | A1 | 7/2002 | Brown | | |
| 2008/0280704 | A1 * | 11/2008 | Noll | A63B 69/0071 | 473/447 |
| 2016/0346660 | A1 | 12/2016 | Johnson | | |
| 2020/0384340 | A1 | 12/2020 | Sabers | | |
| 2021/0187375 | A1 | 6/2021 | Postel | | |

FOREIGN PATENT DOCUMENTS

| | | |
|---|---|---|
| WO | WO2016196607 | 12/2016 |

* cited by examiner

*Primary Examiner* — Nini F Legesse

(57) ABSTRACT

A basketball shooting training device for improving shooting of a basketball includes a mat that is positioned on a surface proximate to a basketball basket so that a front edge of the mat is substantially perpendicular to an imaginary line extending axially from a hoop of the basketball basket. A plurality of guidelines is positioned on an upper face of the mat, with each guideline extending linearly from a respective front corner to a respective opposed edge of the mat at a respective angle relative to the front edge. Thus, the plurality of guidelines defines a plurality of angles relative to the front edge. A respective guideline guides positioning of feet of a user so that the user's torso is angled substantially equivalently to the front edge as is the respective guideline. The device promotes proper shot form and muscle memory.

18 Claims, 6 Drawing Sheets

BASKETBALL SHOOTING TRAINING DEVICE AND METHOD OF USE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to training devices and more particularly pertains to a new training device for improving shooting of a basketball. The present invention discloses a training device that promotes proper shot form and muscle memory of the proper shot form.

(2) Description of Related Art Including Information Disclosed Under 37 CFR 1.97 and 1.98

The prior art relates to training devices, the most relevant of which is U.S. Patent Application No. 2008/0280704A1, which discloses a mat having indicia on its upper face for placement of a leading foot and trailing foot of a user training a basketball shot. The indicia comprise outlines of feet that generate a single orientation of the user's torso relative to a front edge of the mat, and thus a basket around which the mat is positioned. In contrast, the indicia on the mat of the present invention provide three lines for positioning of the player's feet, which generate three different orientations of the user's torso relative to the front edge of the mat and the basket. The present invention allows a user to explore shooting of the basketball with their torso in different orientations to select the one which is most effective and comfortable.

Additional prior art training devices comprise foot placement mats for exercisers, golfers, and wrestlers. Related prior art comprises non-mat devices for guiding foot placement for batters and golfers.

(h) BRIEF SUMMARY OF THE INVENTION

An embodiment of the disclosure meets the needs presented above by generally comprising a mat, which has a lower face that is configured to be positioned on a surface proximate to a basketball basket so that a front edge of the mat is substantially perpendicular to an imaginary line extending axially from a hoop of the basketball basket. A plurality of guidelines is positioned on an upper face of the mat, with each guideline extending linearly from a respective front corner to a respective opposed edge of the mat at a respective angle relative to the front edge. Thus, the plurality of guidelines defines a plurality of angles relative to the front edge. A respective guideline is configured to guide positioning of feet of a user so that a torso of the user is angled substantially equivalently to the front edge as is the respective guideline.

Another embodiment of the disclosure includes a method of training a basketball player. The method comprises a provision step, which entails providing a basketball shooting training device, according to the disclosure above. Preparatory steps of the method are positioning the mat on the surface proximate to the basketball basket with the shot line being aligned with the imaginary line extending axially from the hoop of the basketball basket and confirming that the front edge is substantially perpendicular to the imaginary line. Use steps of the method are positioning the basketball player's leading foot in the leading foot outline, positioning the basketball player's trailing foot in a respective one of the trailing foot outlines based on an inseam of the basketball player, and instructing the basketball player to shoot a basketball at the basketball basket.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
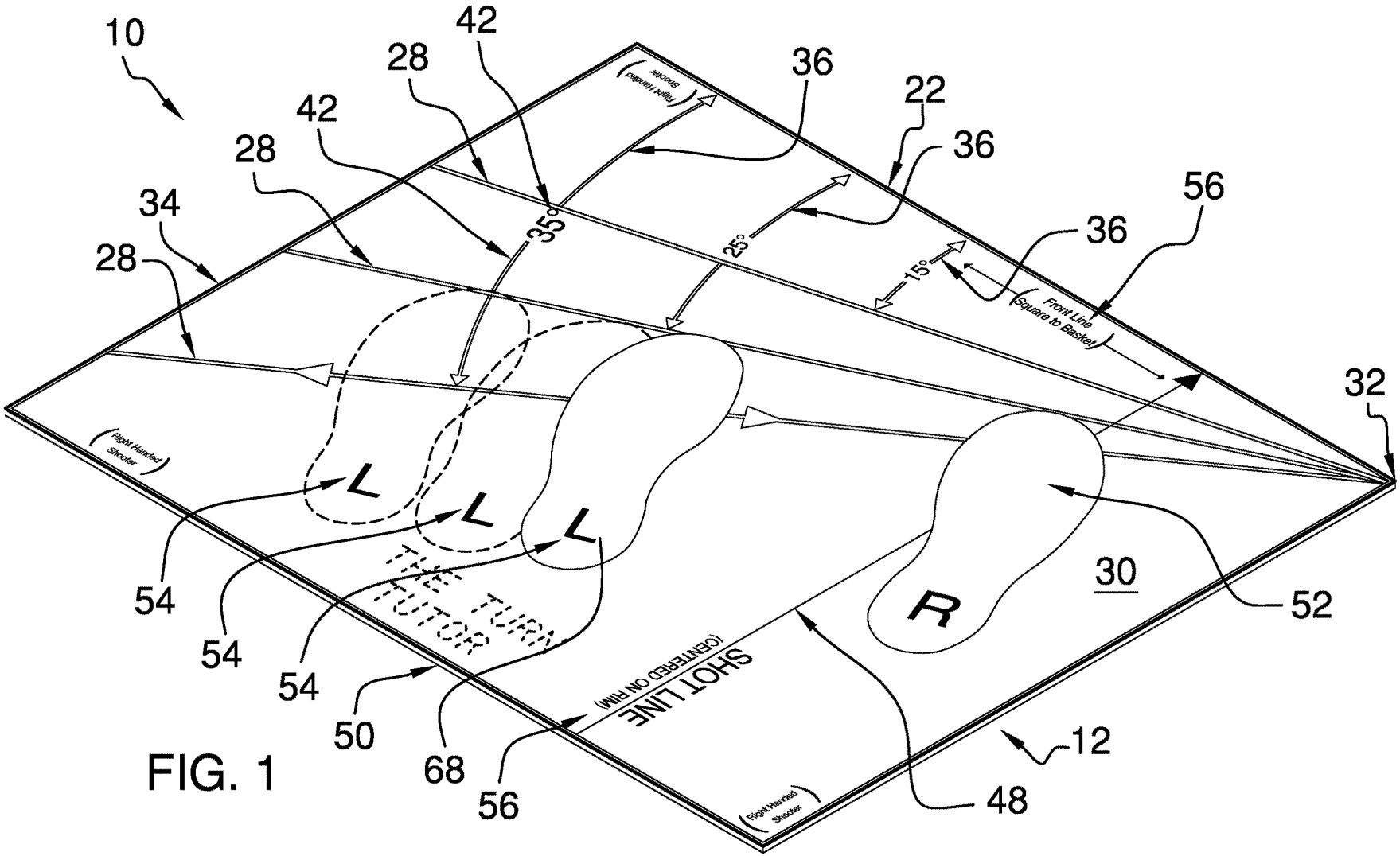
FIG. 1 is a top isometric perspective view of a basketball shooting training device according to an embodiment of the disclosure.
Figure 2:
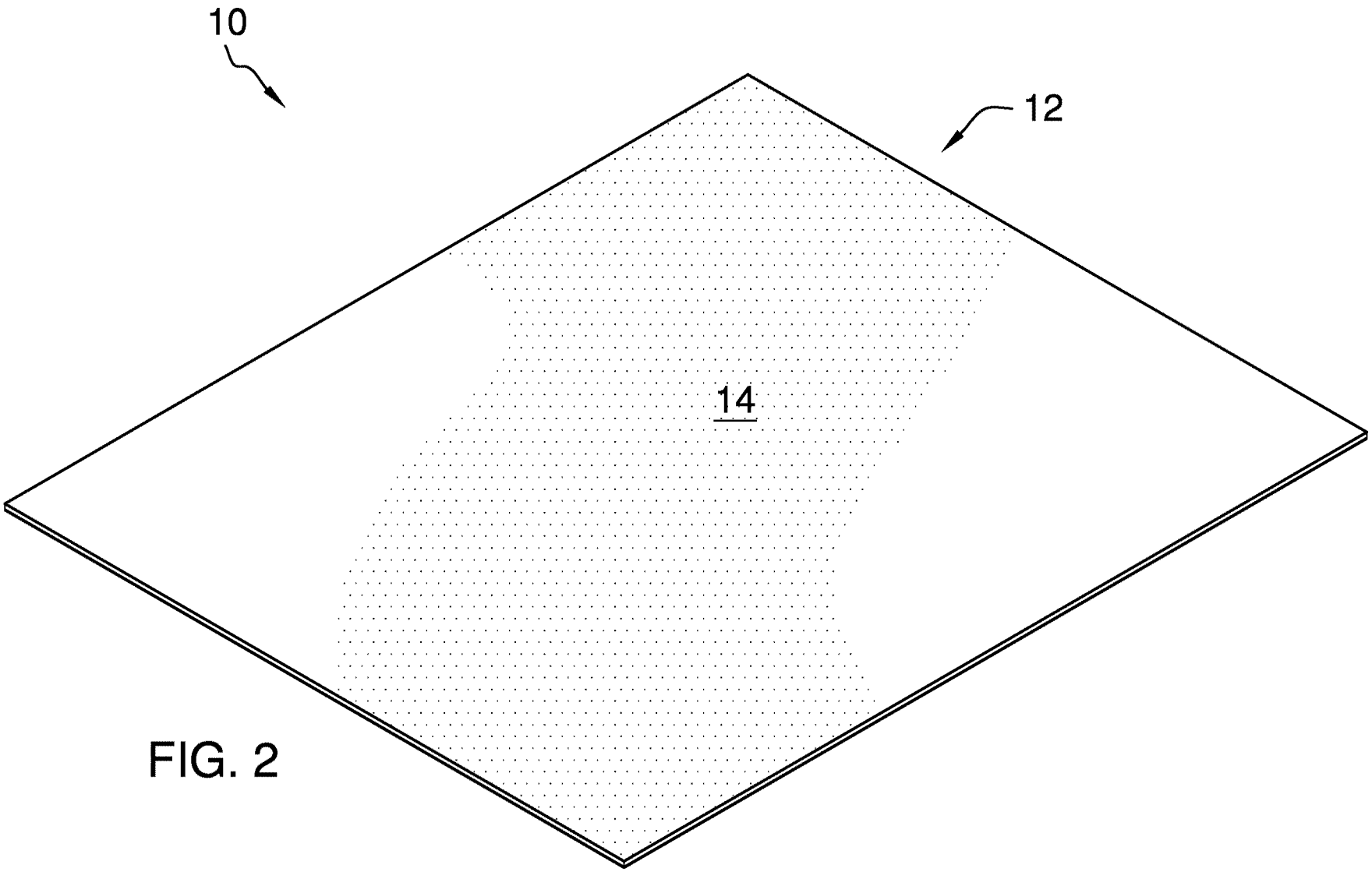
FIG. 2 is a bottom isometric perspective view of an embodiment of the disclosure.

With reference now to the drawings, and in particular to FIGS. 1 through 6 thereof, a new training device embodying the principles and concepts of an embodiment of the disclosure and generally designated by the reference numeral 10 will be described.

As best illustrated in FIGS. 1 through 6, the basketball shooting training device 10 generally comprises a mat 12, which has a lower face 14 that is configured to be positioned on a surface 16, such as a basketball court 18, a driveway, or the like, proximate to a basketball basket 20. The mat 12 is positioned so that a front edge 22 of the mat 12 is substantially perpendicular to an imaginary line 24 extending axially from a hoop 26 (also called a "rim") of the basketball basket 20. The lower face 14 is textured and thus is configured to frictionally engage the surface 16, thereby limiting movement of the mat 12 while in use. The mat 12 comprises one or more of rubber, polychloroprene, silicone, or the like.

Figure 4:
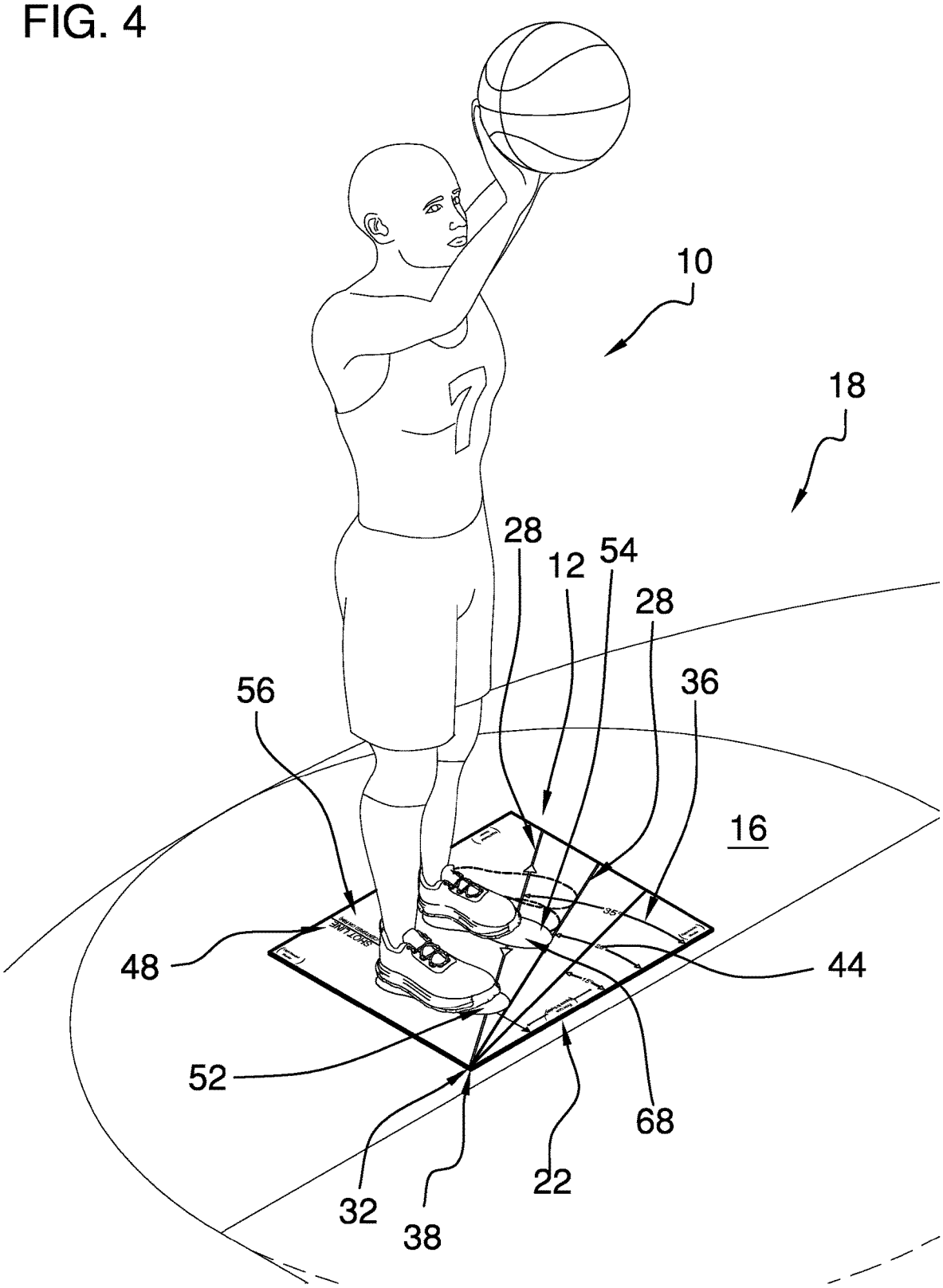
FIG. 4 is an in-use view of an embodiment of the disclosure.

A plurality of guidelines 28 is positioned on an upper face 30 of the mat 12, with 30 each guideline 28 extending linearly from a respective front corner 32 to a respective opposed edge 34 of the mat 12 at a respective angle 36 relative to the front edge 22. Thus, the plurality of guidelines 28 defines a plurality of angles 36 relative to the front edge 22. A respective guideline 28 is configured to guide positioning of feet of a user, as shown in FIG. 4, so that a torso of the user is angled substantially equivalently to the front edge 22 as is the respective guideline 28. As shown in FIG. 1, the plurality of guidelines 28 comprises three guidelines 28, although the present invention also anticipated the plurality of guidelines 28 comprising two, four, or more guidelines 28. Additionally, the guidelines 28 are anticipated to be removably attachable to the mat 12, thereby allowing the user to select any angle 36 relative to the front edge 22.

The guidelines 28, as shown in FIG. 1, are positioned at 15.0°, 25.0°, and 35.0° relative to the front edge 22. As will become apparent, these angles 36 span a range of angles 36 which are comfortable to a variety of users and which lead to good positioning of the user's torso relative to the basketball basket 20. As is shown in FIG. 1, the toes of both feet of the user are positioned adjacent to a respective guideline 28, which is a natural positioning of the feet for shooting a comfortable shot.

Figure 5:
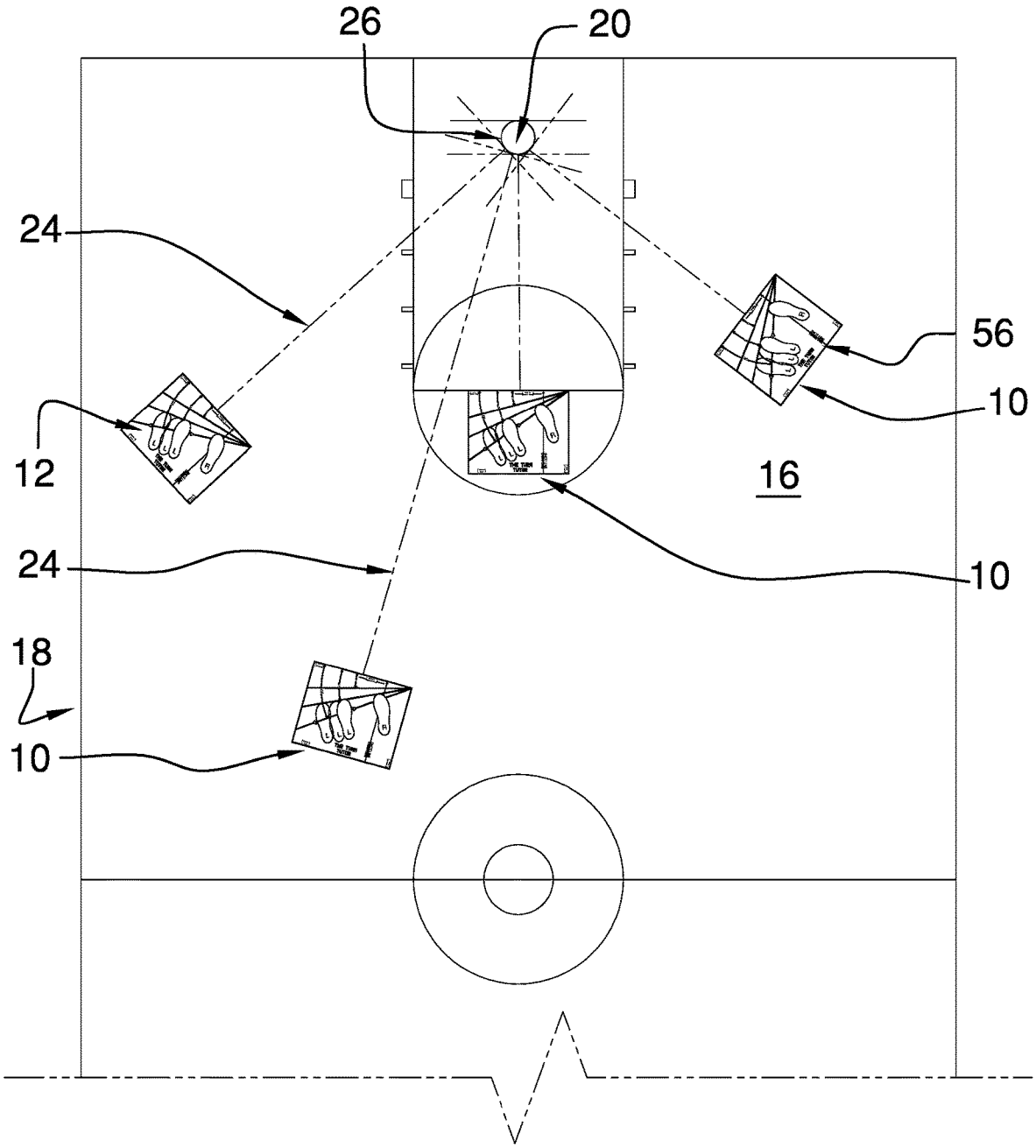
FIG. 5 is an in-use view of an embodiment of the disclosure.
Figure 6:
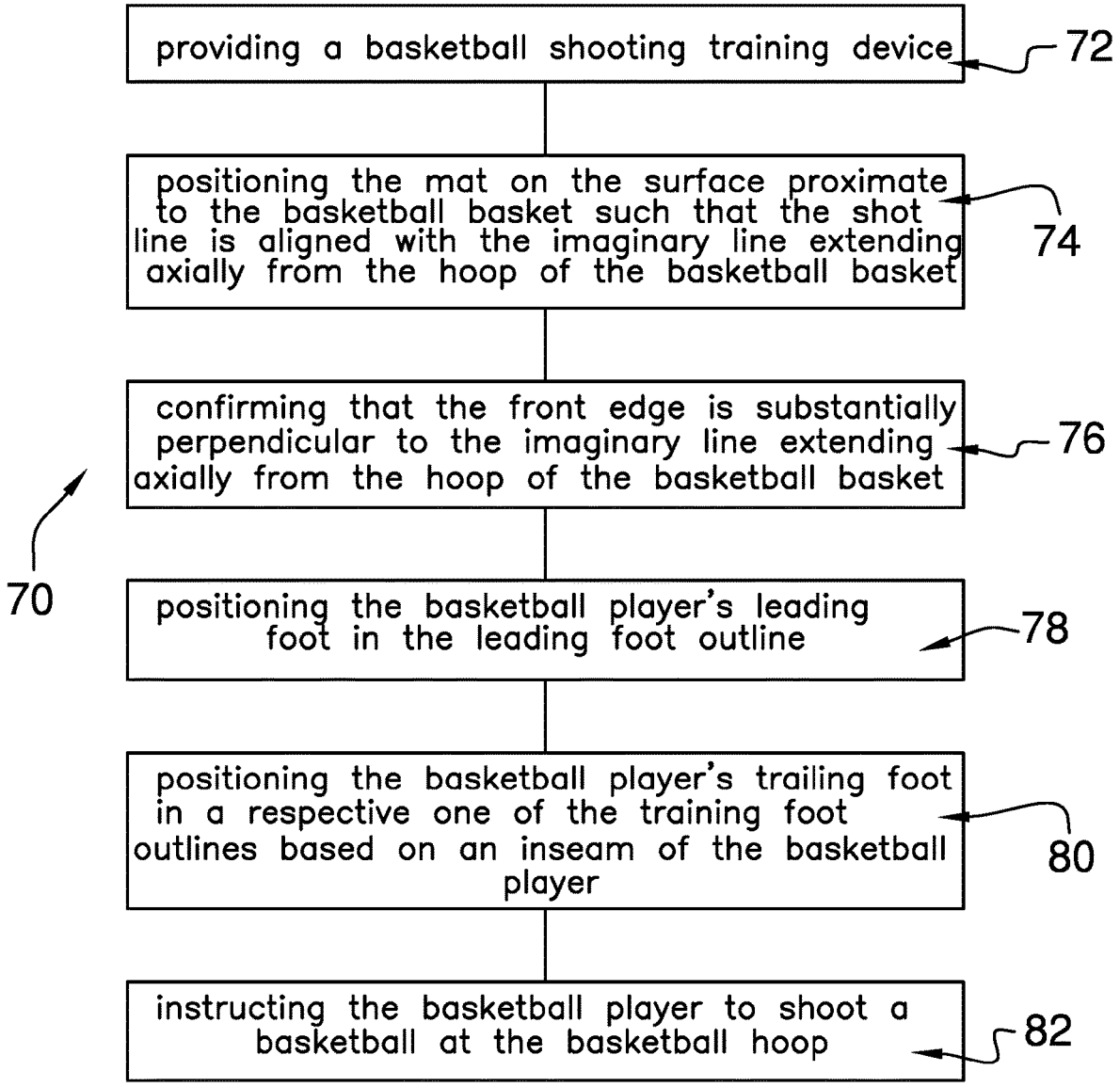
FIG. 6 is a flow diagram for a method utilizing an embodiment of the disclosure.

For shot training purposes, the mat 12 is sequentially positioned at different locations on the surface 16 relative to the basketball basket 20, as shown in FIG. 5. The present invention is anticipated to be useful in training a user proper shot form having proper body alignment, no or minimal trapezius muscle shoulder tension, or elbow displacement commonly referred to as chicken wing elbow. Training with the present invention induces muscle memory enabling the user to perfect a more relaxed, fluid, and consistent shot with less variation shot-to-shot and day-to-day.

Figure 3:
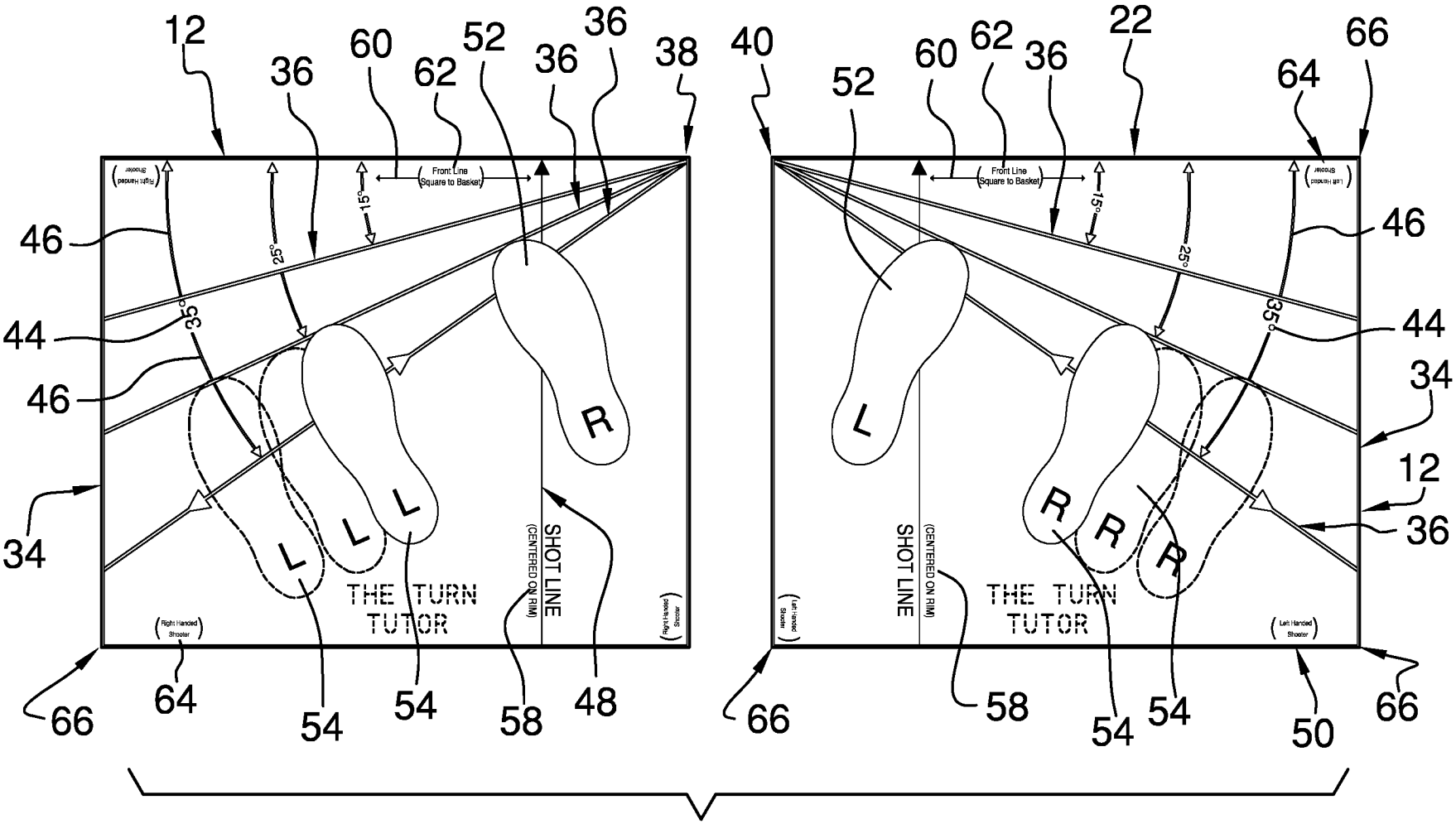
FIG. 3 is a top view of an embodiment of the disclosure.

As is shown in FIG. 3, left, wherein the guidelines 28 extend from a front right corner 38 of the mat 12, the basketball shooting training device 10 is configured to train right handed shots and would be most useful for a right handed user. Conversely, when the guides extend from a front left corner 40 of the mat 12, as shown in FIG. 3, right, the basketball shooting training device is configured to train left handed shots and would be most useful for a left handed user. The present invention also anticipates the upper face 30 of the mat 12 being configured to train right handed shots and the lower face 14 of the mat 12 being configured to train left handed shots.

Indicia 42 are positioned on the upper face 30 of the mat 12. The indicia 42 comprise a plurality numerals 44 that correspond to the respective angles 36 of the guidelines 28 relative to the front edge 22. The indicia 42 are configured to indicate the respective angle 36 of each guideline 28 relative to the front edge 22. The indicia 42 also may comprise a plurality of curved arrows 46, which is positioned on the mat 12 such that each numeral 44 is bracketed by a pair of curved arrows 46, which extend singly from the numeral 44 to a respective guideline 28 and to the front edge 22.

A shot line 48 is positioned on the upper face 30 of the mat 12 and extends substantially between the front edge 22 and a rear edge 50 of the mat 12 proximate to the respective front corner 32. The shot line 48 is configured to be aligned with the imaginary line 24 that extends axially from the hoop 26 to facilitate positioning of the front edge 22 substantially perpendicularly to the imaginary line 24. The shot line 48 also is configured for positioning of the leading foot of the user. The shot line 48 may be labeled "SHOT LINE" to provide direction to the user.

A leading foot outline 52, which is shaped complementarily to the leading foot of the user, is positioned proximate to the front corner 32. Upon positioning of the leading foot of the user within the leading foot outline 52, the toes of the user are positioned adjacent to one of the guidelines 28. The leading foot outline 52 thus is configured to guide placement of the leading foot of the user. As is shown in FIG. 1, the leading foot outline 52 is positioned on the shot line 48. When using guidelines 28 having respective angles 36 that are smaller than the respective angle 36 having the largest respective angle 36 relative to the front edge 22, the leading foot is simply positioned in alignment with and partially within the leading foot outline 52.

A set of trailing foot outlines 54, each of which is shaped complementarily to the trailing foot of the user, is positioned distal to the front corner 32 along the respective guideline 28 having the largest respective angle 36 relative to the front edge 22. Upon positioning of the trailing foot of the user within a respective the trailing foot outline 54, the toes of the trailing foot are positioned adjacent to the same guideline 28 as are the toes of the leading foot. The respective trailing foot outline 54 thus is configured to guide placement of the trailing foot of the user. The set of trailing foot outlines 54 may comprise three trailing foot outlines 54, which provide for different spacing of the user's leading foot and trailing foot based on an inseam of the user. The present invention also anticipates the set of trailing foot outlines 54 comprising two, four, or more trailing foot outlines 54.

A set of instructions 56, which is attached to the upper face 30 of the mat 12, provides directions for use. The set of instructions 56 comprises a first label 58, which is positioned adjacent to the shot line 48 and which reads "CENTERED ON RIM". The set of instructions 56 also comprises a front line 60, which is positioned on the upper face 30 proximate to and parallel to the front edge 22 of the mat 12, and a second label 62, which reads "FRONT LINE" and "Square to Basket" and which is positioned adjacent to the front line 60. The set of instructions 56 also may comprise at least one corner label 64, which is positioned proximate to a corner 66 of the mat 12 from which the plurality of guidelines 28 does not extend. The corner label 64 reads either "Right Handed Shooter" or "Left Handed Shooter" for a mat 12 that is configured to train right handed shots and left handed shots, respectively.

The present invention anticipates alternatives wording for the set of instructions 56, such as the first label 58 reading "Centered on Rim" or "Point to Center of Hoop", the second label 62 reading "Position Front Edge Square to Basket", or the like.

As shown in FIG. 3, the present invention anticipates an innermost one 68 of the trailing foot outlines 54 being solid with the remaining two trailing foot outlines 54 being dashed. Such a configuration would prompt the user to use the innermost one 68 of the trailing foot outlines 54 first, and, if this is uncomfortable, to then try the remaining trailing foot outlines 54 in order.

The present invention also anticipates an "R" or an "L" being positioned in the leading foot outline 52 and each trailing foot outline 54, respectively, to indicate that the leading foot outline 52 and the trailing foot outlines 54 are configured for positioning of the right or left foot of the user, respectively, depending on whether the basketball shooting training device 10 is configured for training right-handed shots or left-handed shots, respectively.

In use, the basketball shooting training device 10 enables a method of training a basketball player 70. The method 70 comprises a provision step 72, which entails providing a basketball shooting training device 10, according to the specification above. A first preparatory step 74 of the method 70 is positioning the mat 12 on the surface 16 proximate to the basketball basket 20 such that the shot line 48 is aligned with the imaginary line 24 extending axially from the hoop 26 of the basketball basket 20. A second preparatory step 76 of the method 70 is confirming that the front edge 22 is substantially perpendicular to the imaginary line 24 extends axially from the hoop 26 of the basketball basket 20.

A first use step 78 of the method 70 is positioning the basketball player's leading foot in the leading foot outline 52. A second use step 80 of the method 70 is positioning the basketball player's trailing foot in a respective one of the trailing foot outlines 54 based on an inseam of the basketball player. A third use step 82 of the method 70 is instructing the basketball player to shoot a basketball at the basketball basket 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A basketball shooting training device comprising:

a mat having a lower face configured for positioning on a surface proximate to a basketball basket, such that a front edge of the mat is substantially perpendicular to an imaginary line extending axially from a hoop of the basketball basket; and a plurality of guidelines positioned on an upper face of the mat, each guideline of the plurality of guidelines extending linearly from a common front corner to a respective opposed edge of the mat at a respective angle relative to the front edge, such that the plurality of guidelines defines a plurality of angles relative to the front edge, wherein a respective guideline of the plurality of guidelines is configured for guiding positioning of feet of a user, such that a torso of the user is angled substantially equivalently to the front edge as is the respective guideline.

2. The basketball shooting training device of claim 1, wherein the lower face is textured, wherein the lower face is configured for frictionally engaging the surface.

3. The basketball shooting training device of claim 1, wherein the mat comprises one or more of rubber, polychloroprene, and silicone.

4. The basketball shooting training device of claim 1, wherein the plurality of guidelines comprises three guidelines.

5. The basketball shooting training device of claim 4, wherein the guidelines of the plurality of guidelines are positioned at 15.0°, 25.0°, and 35.0° relative to the front edge.

6. The basketball shooting training device of claim 1, further including indicia positioned on the upper face of the mat, the indicia comprising a plurality numerals corresponding to the respective angles of the guidelines of the plurality of guidelines relative to the front edge, wherein the indicia are configured for indicating the respective angle of each guideline of the plurality of guidelines relative to the front edge.

7. The basketball shooting training device of claim 6, wherein the indicia comprise a plurality of curved arrows positioned on the mat such that each numeral is bracketed by a pair of curved arrows, the curved arrows of the pair of curved arrows extending singly from a respective numeral to a respective guideline and to the front edge.

8. The basketball shooting training device of claim 1, further including a shot line positioned on the upper face of the mat and extending substantially between the front edge and a rear edge of the mat proximate to the respective front corner, wherein the shot line is configured for aligning with the imaginary line extending axially from the hoop of the basketball basket for facilitating positioning of the front edge substantially perpendicularly to the imaginary line extending axially from the hoop of the basketball basket, and wherein the shot line is configured for positioning of the leading foot of the user.

9. The basketball shooting training device of claim 8, wherein the shot line is labeled "SHOT LINE".

10. The basketball shooting training device of claim 8, further including a leading foot outline shaped complementarily to the leading foot of the user and positioned proximate to the front corner, such that, upon positioning of the leading foot of the user within the leading foot outline, the toes of the leading foot are positioned adjacent to a respective guideline, wherein the leading foot outline is configured for guiding placement of the leading foot of the user.

11. The basketball shooting training device of claim 10, wherein the leading foot outline is positioned on the shot line.

12. The basketball shooting training device of claim 10, further including a set of trailing foot outlines shaped complementarily to the trailing foot of the user and being positioned distal to the front corner along the respective guideline, such that, upon positioning of the trailing foot of the user within a respective the trailing foot outline, the toes of the trailing foot of the user are positioned adjacent to the respective guideline, wherein a respective trailing foot outline of the set of trailing foot outlines is configured for guiding placement of the trailing foot of the user.

13. The basketball shooting training device of claim 12, wherein the set of trailing foot outlines comprises three trailing foot outlines.

14. The basketball shooting training device of claim 8, further including a set of instructions attached to the upper face of the mat providing directions for use.

15. The basketball shooting training device of claim 14, wherein the set of instructions comprises:

a first label adjacent to the shot line reading "CENTERED ON RIM;"

a front line proximate to and parallel to the front edge of the mat; and a second label reading "FRONT LINE" and "Square to Basket" adjacent to the front line.

16. The basketball shooting training device of claim 15, wherein the set of instructions comprises at least one corner label positioned proximate to a respective corner of the mat from which the plurality of guidelines does not extend, the corner label reading either "Right Handed Shooter" or "Left Handed Shooter" for a mat configured for training right handed shots and left handed shots, respectively.

17. A basketball shooting training device comprising:

a mat having a lower face configured for positioning on a surface proximate to a basketball basket, such that a front edge of the mat is substantially perpendicular to an imaginary line extending axially from a hoop of the basketball basket, the lower face being textured, wherein the lower face is configured for frictionally engaging the surface, the mat comprising one or more of rubber, polychloroprene, and silicone;

a plurality of guidelines positioned on an upper face of the mat, each guideline of the plurality of guidelines extending linearly from a common front corner to a respective opposed edge of the mat at a respective angle relative to the front edge, such that the plurality of guidelines defines a plurality of angles relative to the front edge, wherein a respective guideline of the plurality of guidelines is configured for guiding positioning of feet of a user, such that a torso of the user is angled substantially equivalently to the front edge as is the respective guideline, the plurality of guidelines comprising three guidelines, the guidelines of the plurality of guidelines being positioned at 15.0°, 25.0°, and 35.0° relative to the front edge;

indicia positioned on the upper face of the mat, the indicia comprising a plurality numerals corresponding to the respective angles of the guidelines of the plurality of guidelines relative to the front edge, wherein the indicia are configured for indicating the respective angle of each guideline of the plurality of guidelines relative to the front edge, the indicia comprising a plurality of curved arrows positioned on the mat such that each numeral is bracketed by a pair of curved arrows, the curved arrows of the pair of curved arrows extending singly from a respective numeral to a respective guideline and to the front edge;

a shot line positioned on the upper face of the mat and extending substantially between the front edge and a rear edge of the mat proximate to the respective front corner, wherein the shot line is configured for aligning with the imaginary line extending axially from the hoop of the basketball basket for facilitating positioning of the front edge substantially perpendicularly to the imaginary line extending axially from the hoop of the basketball basket, and wherein the shot line is configured for positioning of the leading foot of the user, the shot line being labeled "SHOT LINE";

a leading foot outline shaped complementarily to the leading foot of the user and positioned proximate to the front corner, such that, upon positioning of the leading foot of the user within the leading foot outline, the toes of the leading foot are positioned adjacent to a respective guideline, wherein the leading foot outline is configured for guiding placement of the leading foot of the user, the leading foot outline being positioned on the shot line;

a set of trailing foot outlines shaped complementarily to the trailing foot of the user and being positioned distal to the front corner along a respective guideline, such that, upon positioning of the trailing foot of the user within a respective the trailing foot outline, the toes of the trailing foot of the user are positioned adjacent to the respective guideline, wherein a respective trailing foot outline of the set of trailing foot outlines is configured for guiding placement of the trailing foot of the user, the set of trailing foot outlines comprising three trailing foot outlines; and a set of instructions attached to the upper face of the mat providing directions for use, the set of instructions comprising:

a first label adjacent to the shot line reading "CENTERED ON RIM,"

a front line proximate to and parallel to the front edge of the mat, a second label reading "FRONT LINE" and "Square to Basket" adjacent to the front line, and at least one corner label positioned proximate to a respective corner of the mat from which the plurality of guidelines does not extend, the corner label reading either "Right Handed Shooter" or "Left Handed Shooter" for a mat configured for training right handed shots and left handed shots, respectively.

18. A method of training a basketball player comprising the steps of:

providing a basketball shooting training device comprising:

a mat having a lower face configured for positioning on a surface proximate to a basketball basket, such that a front edge of the mat is substantially perpendicular to an imaginary line extending axially from a hoop of the basketball basket; and a plurality of guidelines positioned on an upper face of the mat, each guideline of the plurality of guidelines extending linearly from a common front corner to a respective opposed edge of the mat at a respective angle relative to the front edge, such that the plurality of guidelines defines a plurality of angles relative to the front edge, wherein a respective guideline of the plurality of guidelines is configured for guiding positioning of feet of a user, such that a torso of the user is angled substantially equivalently to the front edge as is the respective guideline, a shot line positioned on the upper face of the mat and extending substantially between the front edge and a rear edge of the mat proximate to the respective front corner, wherein the shot line is configured for aligning with the imaginary line extending axially from the hoop of the basketball basket for facilitating positioning of the front edge substantially perpendicularly to the imaginary line extending axially from the hoop of the basketball basket, and wherein the shot line is configured for positioning of the leading foot of the user, a leading foot outline shaped complementarily to the leading foot of the user and positioned proximate to the front corner, such that, upon positioning of the leading foot of the user within the leading foot outline, the toes of the leading foot are positioned adjacent to a respective guideline, wherein the leading foot outline is configured for guiding placement of the leading foot of the user, the leading foot outline being positioned on the shot line, and a set of trailing foot outlines shaped complementarily to the trailing foot of the user and being positioned distal to the front corner along the respective guideline, such that, upon positioning of the trailing foot of the user within a respective the trailing foot outline, the toes of the trailing foot are positioned adjacent to the respective guideline, wherein a respective trailing foot outline of the set of trailing foot outlines is configured for guiding placement of the trailing foot of the user;

positioning the mat on the surface proximate to the basketball basket such that the shot line is aligned with the imaginary line extending axially from the hoop of the basketball basket;

confirming that the front edge is substantially perpendicular to the imaginary line extending axially from the hoop of the basketball basket;

positioning the basketball player's leading foot in the leading foot outline;

positioning the basketball player's trailing foot in a respective one of the trailing foot outlines based on an inseam of the basketball player; and instructing the basketball player to shoot a basketball at the basketball basket.

* * * * *